United States Patent [19]

Bone

[11] Patent Number: 4,778,095

[45] Date of Patent: Oct. 18, 1988

[54] VARIABLE PITCH ADVANCE OF FASTENERS

[75] Inventor: Arnold Bone, Needham, Mass.

[73] Assignee: Dennison Manufacturing Company, Framingham, Mass.

[21] Appl. No.: 61,849

[22] Filed: Jun. 11, 1987

[51] Int. Cl.[4] ..... B25C 5/11

[52] U.S. Cl. ..... 227/67

[58] Field of Search ..... 227/67

[56] References Cited

U.S. PATENT DOCUMENTS 4,416,407 11/1983 Bone ..... 227/67

4,511,073 4/1985 Furutsu ..... 227/67

*Primary Examiner*—Paul A. Bell

*Attorney, Agent, or Firm*—George E. Kersey

[57] ABSTRACT

Advance of fasteners by a feed wheel having involute shaped teeth, acting in cooperation with a side engaging pawl.

8 Claims, 3 Drawing Sheets

VARIABLE PITCH ADVANCE OF FASTENERS

BACKGROUND OF THE INVENTION

The present invention relates to the installation of fasteners in assemblages and more particularly to advancing of fasteners in an installation apparatus.

A popular fastener installation apparatus is shown and described in my U.S. Pat. No. 4,416,407. The apparatus installs fasteners of the type disposed on a connecting bar, and which include a plurality of evenly spaced, coplanar stubs; a cross bar angularly disposed about the end of each stub; a filament extending from each cross bar; and, typically, a head portion attached to each filament.

A feed wheel having circumferential teeth engages the fastener stubs and is rotated to advance the assemblage, thus positioning a fastener for ejection. This apparatus is designed to provide optimum performance in the installation of fasteners disposed along the connecting bar at one designated pitch. However, fasteners are provided in a variety of pitches, and may even vary in pitch among molds of the same design.

It is therefore an object of the present invention to provide a fastener installation apparatus which provides for relatively great latitude in pitch. .

It is an additional object of the invention to provide assembalge advancing means which offer improved reliability and smoothness of operation.

SUMMARY OF THE INVENTION

In accomplishing the foregong and related objects, the invention provides for feeding and installation of fasteners in assemblages.

In accordance with one aspect of the invention, a feed wheel is provided having a plurality of evenly spaced involute shaped teeth.

In accordance with another aspect of the invention, a pawl engages the wheel from the side, wherein the pawl engagement member contacts a narrow area of the tooth surface in a controlled manner.

In accordance with another aspect of the invention, great tolerance to variations in pitch is provided, thus reducing the incidence of jamming and misfeeding. Moreover, assemblages of widely differing pitch may be installed by a single apparatus in accordance with the invention.

BRIEF DESCRIPTION OF THE DRAWINGS

Other aspects of the invention will become apparent after considering several illustrative embodiments taken in conjunction with the drawings in which.

DETAILED DESCRIPTION OF THE INVENTION

Figure 2:
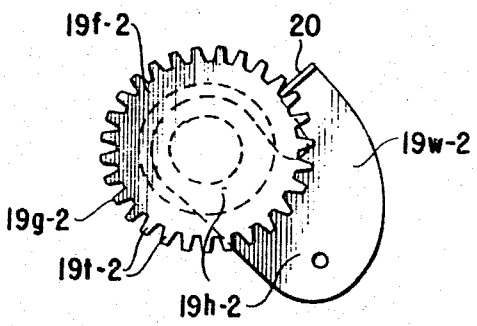
FIG. 2 is an enlarged view of the feed wheel and pawl of FIG. 1.
Figure 1:
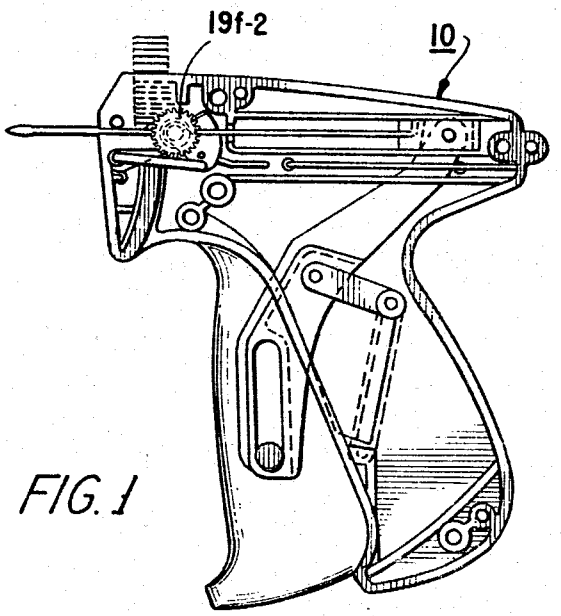
FIG. 1 is a section view of a fastener installation apparatus in accordance with the invention.

With reference to FIGS. 1 and 2, the present invention provides a fastener installation apparatus 10 which includes a feed wheel **19*f*-2 having involute shaped gear teeth 19*t*-2. A pawl, 19*w*-2, acts upon teeth 19*t*-2** to reliably advance fasteners in assemblages.

In a preferred embodiment of the invention, feed wheel **19*f*-2 and pawl 19*w*-2 replace elements 19*f* and 19*w* of U.S. Pat. No. 4,416,407 (the '407 Patent). However, it will be understood from the description below that a variety of triggering mechanisms and frames may be used in conjunction with the elements of the invention. In the '407 Patent, teeth 19t have a linear side profile, with a blunt apex. As shown in FIGS. 1 and 2, the invention provides teeth 19*t*-2 which have an involute shape, with a more narrow apex 19*g*-2. A pawl 19*w*-2 includes a planar span 19*h*-2 lying coplanar with feed wheel 19*f*-2, sharing a common axis of rotation with same. An upwardly angled engagement member 20 extends from span 19*h*-2, and contacts teeth 19*t*-2 along a narrow region of the tooth surface, in a side acting manner. Biasing means are provided, such as a curved biasing washer 21**, for urging the pawl into contact with the feed wheel undersurface.

As feed wheel **19*w*-2 is rotated, fastener stubs 28 fit between consecutive teeth 19*t*-2. In a preferred embodiment, stubs 28 are sized to reside at a depth equal to the pitch line of the teeth. This provides for smoothest entry and exit of stubs 28** from the feed wheel.

The combination of involute shaped teeth and side acting pawl has been found to provide improved reliability, as evidenced by a smoother, more reliable lead-in of the fastener assemblage, as well as the reduced occurrence of jamming.

Figure 4A:
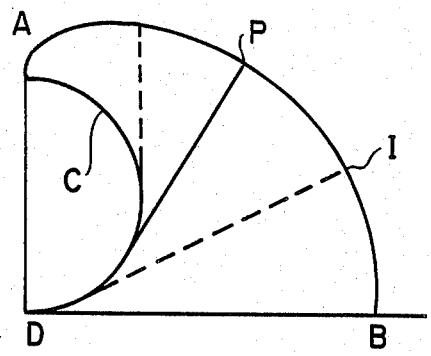
FIG. 4A is an illustration setting forth the standard procedure for forming an involute surface as required by the invention.
Figure 4B:
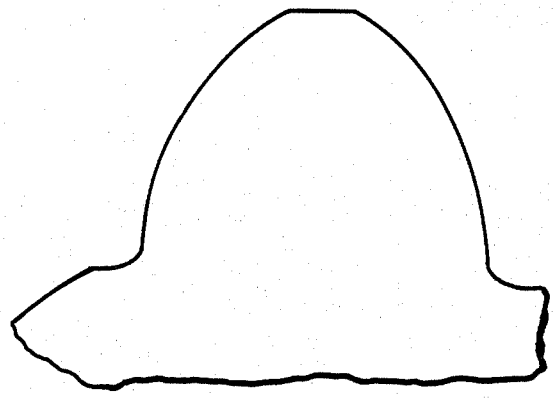
FIG. 4B is an enlarged portion of a gear tooth having an involute surface in accordance with the invention.

FIG. 4A shows the formation of an involute as the curve I traced by any point P of a taute string S when it is wound upon a fixed curve C on the same plane as the involute. An involute is also defined as the locus of any fixed point on a moving tangent which rolls but does not slide on a curve. In FIG. 4A the entire involute extends from A-B. In FIG. 4B the portion PB of the involute AB of FIG. 4A has been applied to form a surface of an illustrative gear tooth.

Figure 3:
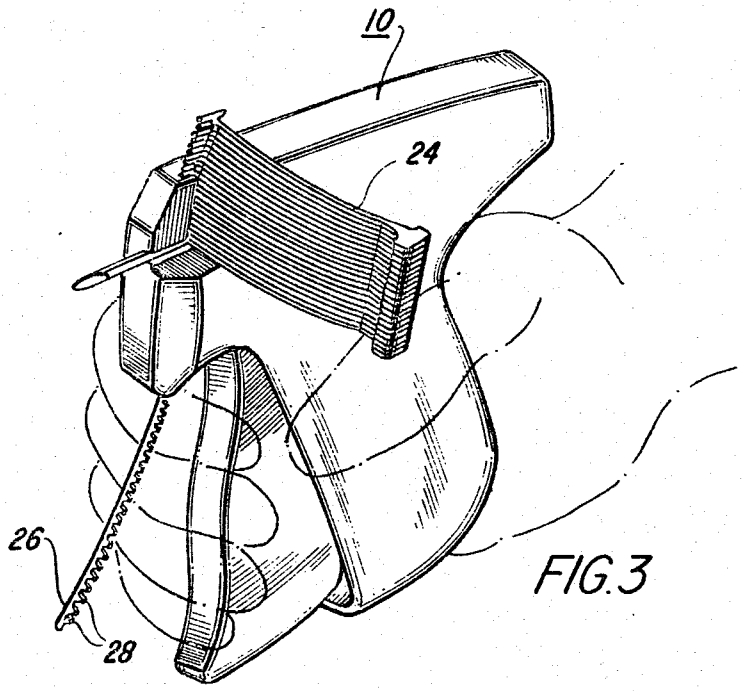
FIG. 3 is a perspective view of the apparatus of FIG. 1 showing an installed fastener assemblage.

The invention additionally provides for greater tolerance to differences in fastener pitch, that is, the distance between fasteners 24 on the connecting bar 26, as shown in FIG. 3. For example, different molds may be designed to produce fastener assemblages of the same pitch, yet the resultant pitch may vary, depending on molding conditions. Further, different manufacturers may produce assemblages of slightly different pitch. Moreover, differences in assemblage quality can lead to artificial differences in pitch. For example, flash, the excess material which may be found at the mold parting line, can cause feeding problems. By providing for greater latitude in pitch, the present invention reduces the incidence of jamming or misfeeding which commonly results from these variations.

The invention additionally provides for variable pitch feeding. A popular fastener assemblage has a pitch of approximately 0.08 inches. Another popular fastener assemblage, known as the close pitch fastener, has a pitch of approximately 0.045 inches. It has been found that cutting a 0.45 inch diameter feed wheel **19*t*-2 with a diametral pitch of 64 enables the feeding of both pitches. Similarly, other approximate pitch multiples may be advanced by altering the pitch and diameter of feed wheel 19*f*-2**.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

What is claimed is:

1. Apparatus for installing fasteners of the type comprising a plurality of fasteners disposed on a connecting bar with a plurality of spaced coplanar stubs, with one end of each stub connected to the connecting bar, a cross bar angularly disposed about the other end of each stub, and a filament extending from each cross bar, the fasteners so disposed on the connecting bar comprising a clip, said apparatus comprising:

a housing; means mounted on said housing for storing a clip of fasteners; means mounted on said housing for feeding fasteners in a clip from said storing means to a driving station within said housing where an individual fastener is separated from the connecting bar and expelled from the housing, said feeding means further comprising a feed wheel pivotally mounted within said housing; means for engaging said feed wheel for rotation to feed the fasteners; wherein the improvement comprises said feed wheel having a plurality of circumferential, involute shaped teeth for engaging the fasteners.

2. Apparatus as defined in claim 1 wherein said means for engaging said feed wheel comprises a pawl extending from and sharing a common axis of rotation with said feed wheel, said pawl further comprising a planar span mounting at a free end a tooth which projects at an angle from the planar span to engage the teeth of said feed wheel.

3. Apparatus as defined in claim 2 wherein said tooth engages said feed wheel in a side acting manner.

4. Apparatus as defined in claim 1 wherein the tooth of said planar span projects at a right angle.

5. Apparatus of claim 1, further comprising:

means for biasing said engaging means into contact with an side surface of said feed wheel.

6. Apparatus as defined in claim 5 wherein the biasing means comprises a curved biasing surface.

7. Apparatus as defined in claim 1 wherein said feed wheel has a diameter of about 0.45 inches and a diametral pitch is about 64 to enable the feeding of multiple pitch fasteners.

8. Apparatus as defined in claim 1 wherein the teeth of said feed wheel are evenly spaced.

* * * * *